United States Patent [19]

Tsudaka et al.

[11] Patent Number: 4,484,734

[45] Date of Patent: Nov. 27, 1984

[54] COPY PAPER FEEDING DEVICE FOR A COPYING APPARATUS

[75] Inventors: Hideaki Tsudaka; Takaji Washio; Nobuhiko Kozuka; Masahide Iseki; Toshio Watanabe; Masami Kai; Toshio Yoshiyama; Hiromi Sakata, all of Osaka, Japan

[73] Assignee: Mita Industrial Company Limited, Osaka, Japan

[21] Appl. No.: 400,286

[22] Filed: Jul. 21, 1982

[30] Foreign Application Priority Data

Jul. 21, 1981 [JP] Japan ..... 56-114940

[51] Int. Cl.[3] ..... B65H 1/26; B65H 3/44; B65H 1/04

[52] U.S. Cl. ..... 271/9; 271/114; 271/145; 271/265

[58] Field of Search ..... 271/9, 114, 116, 171, 271/164, 162, 145, 265

[56] References Cited

U.S. PATENT DOCUMENTS

| | | | |
|---|---|---|---|
| 4,190,246 | 2/1980 | Sasuga | 271/145 |
| 4,264,188 | 4/1981 | Tomosada et al. | 355/14 R |
| 4,265,440 | 5/1981 | Shibazaki et al. | 271/9 |
| 4,302,098 | 11/1981 | Kan et al. | 355/3 SH |
| 4,386,769 | 6/1983 | Ito et al. | 271/9 |
| 4,406,537 | 9/1983 | Mori | 355/14 SH |

FOREIGN PATENT DOCUMENTS

| | | | |
|---|---|---|---|
| 0097968 | 8/1979 | Japan | 271/171 |
| 2065611 | 7/1981 | United Kingdom | 271/9 |

*Primary Examiner*—Bruce H. Stoner, Jr.
*Assistant Examiner*—James E. Barlow
*Attorney, Agent, or Firm*—Wenderoth, Lind & Ponack

[57] ABSTRACT

A copy paper feeding device for a copying apparatus includes a plurality of cassettes which are capable of storing copy paper sheets and a feeder which respectively corresponds to each of the cassettes. Each feeder is selectively driven so as to feed the copy paper sheets in the case where the cassettes store copy paper sheets having different sizes and each feeder is driven in a predetermined order so as to feed the copy paper sheets from one cassette until the cassette is empty and then successively feed the copy paper sheets from the remaining cassette in the case where the cassettes store copy paper sheets having the same size. The copy paper feeding device includes a selector for selecting which feeder is to be driven.

1 Claim, 5 Drawing Figures

COPY PAPER FEEDING DEVICE FOR A COPYING APPARATUS

BACKGROUND OF THE INVENTION

1. Field of the Invention

The present invention relates to a copy paper feeding device for a copying apparatus having a plurality of cassettes which are capable of storing copy paper sheets and a feeding means respectively corresponding to each cassette, and more particularly relates to control system for selecting the cassettes.

2. Description of the Prior Art

In one prior art arrangement, each feeding means corresponding to each cassette is respectively driven in a predetermined order so as to feed copy paper sheets from one cassette until the one cassette is empty, and then the remaining feeding means is driven so as to successively feed the copy paper sheets from the remaining cassette corresponding thereto in the case where each of the cassettes stores copy paper sheets having the same size. In this fashion, a large number of copying operations are performed.

However, a significant problem is encountered in such a feeding device. In the case where one of the cassettes stores undesired colored copy paper sheets, even if all the cassettes store copy paper sheets having the same size then the undesired copy paper sheets are also fed.

Accordingly, an object of the present invention is to provide a copy paper feeding device for a copying apparatus which prevents the feeding of the undesired copy paper sheets.

SUMMARY OF THE INVENTION

To accomplish the foregoing objectives, there is provided a feeding device according to the invention for feeding copy papers in a copying apparatus which comprises a plurality of cassettes which are capable of storing copy paper sheets and a feeding means respectively corresponding to each of the cassettes. Each feeding means is selectively driven so as to feed copy paper sheets in the case where each cassette stores copy paper sheets having different sizes. On the contrary, in the case where each cassette stores copy paper sheets having the same size, each feeding means is driven in a predetermined order so as to feed copy papers from one cassette until the one cassette is empty and then the remaining feeding means is driven so as to successively feed copy paper sheets from another cassette. The feeding device comprises means which is respectively situated is a location corresponding to each feeding means for selecting the feeding means to be driven. This selecting means prevents undesired copy paper from being fed so as to prevent copy papers from being wasted and to enhance the easy handling operation for obtaining a copy paper having a desired size.

BRIEF DESCRIPTION OF THE DRAWINGS

A detailed description of the invention will be made with reference to the accompanying drawings which are to scale. Like numerals designate corresponding parts in the several figures.

DETAILED DESCRIPTION OF THE PREFERRED EMBODIMENT

The following detailed description is of the best presently contemplated mode of carrying out the invention. This description is not to be taken in a limiting sense, but is made merely for the purpose of illustrating the principles of the invention since the scope of the invention best is defined by appended claims.

Figure 1:
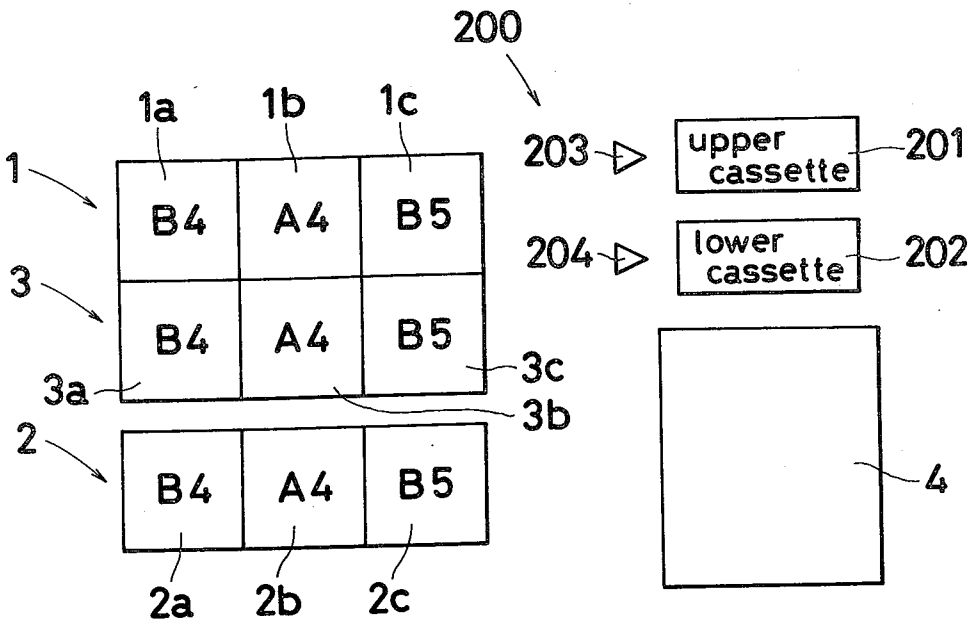
FIG. 1 is a front view showing a part of an operation panel of a copying operation according to one aspect of the invention.
Figure 2:
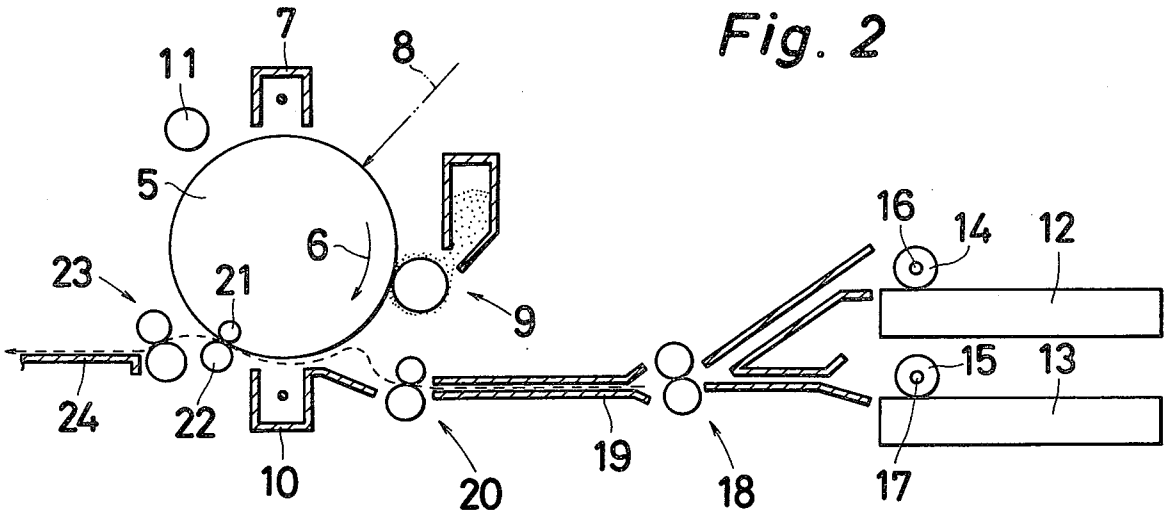
FIG. 2 is a simplified cross-sectional view showing a configuration of the copying apparatus.

FIG. 1 is a front view showing a part of an operation panel of a copying apparatus according to one aspect of the invention. The operation panel of the copying apparatus comprises a display element 1 for displaying the size of the stored copy paper sheets, a operation element 2, a selecting display element 3, a print button 4, feeding roller selecting switches 201 and 202, and a display device 200. The display element 1 for indicating the size of the stored copy paper sheets has a plurality of display lumps, such as the three display lamps 1*a*, 1*b* and 1*c*, respectively corresponding to the JIS (Japanese Industrial Standard) sizes B4, A4 and B5, of the copy paper sheet capable of being copied. The operation element 2 has size selecting switches 2*a*, 2*b* and 2*c* corresponding to the display lamps 1*a*, 1*b* and 1*c*, said switches being used for selecting the size of the copy paper sheet. The selecting display element 3 has display lamps 3*a*, 3*b* and 3*c* respectively corresponding to the display lamps 1*a*, 1*b* and 1*c* for indicating the size of the selected copy paper sheet. The feeding roller selecting switches 201 and 202 respectively correspond to feeding rollers 14 and 15 (as shown in FIG. 2) and are manually operated for feeding the copy paper sheet. The display device 200 has display lamps 203 and 204 respectively corresponding to the feeding roller selecting switches 201 and 202. The print button 4 is also provided in the operation panel.

FIG. 2 is a simplified cross-sectional view illustrating a configuration in the copying apparatus. Around the center of the copying apparatus, a photosensitive drum 5 is rotatably mounted and a photosensitive material is provided over the entire surface of the photosensitive drum 5. There are provided around the photosensitive drum 5, a corona charger 7 for charging the photosensitive material, an exposure means 8 for applying a light image on the photosensitive material to form an electrostatic latent image, a developing device 9 for rendering the electrostatic latent image on the photosensitive material visible to form a toner image and also for cleaning the photosensitive material, a transfer corona charger 10 for transferring the toner image on the photosensitive material to the copy paper sheet, and a charge eraser lamp 11 for erasing electric charges remaining on the photosensitive material after the transfer operation, these elements being in this order along a rotary direction 6 of the photosensitive drum 5.

Cassettes 12 and 13 are capable of being mounted on upper and lower positions of the copying apparatus. Each of the cassettes 12 and 13 is capable of storing the copy paper sheets having a size corresponding to JIS size B4, A4 and B5 selectively. The feeding rollers 14 and 15 are rigidly affixed to rotary shafts 16 and 17 and are respectively disposed so as be in contact with a top layer of the copy paper sheets stacked in the cassettes 12 and 13. According to the manual operation of the selecting switches *2a, 2b* and *2c* of the operation element 2, one of these feeding rollers 14 and 15 is driven to selectively rotate so as to feed the copy paper sheet from one of the cassettes 12 and 13. The copy paper sheet is advanced to a transfer area by a pair of transport rollers 18 through a guide plate 19 and by a pair of carrying rollers 20 to the transfer corona charger 10 so as to contact the photosensitive drum 5. After the transfer operation, the copy paper sheet is nipped between a peel roller 21 and a transport roller 22 on one side in the width direction of the copy paper sheet so as to peel the sheet from the photosensitive drum 5, and is then transported to a fixing device (not shown) through a pair of transport rollers 23 and a guide plate 24 so that the toner image is fixed on the copy paper sheet.

Figure 3:
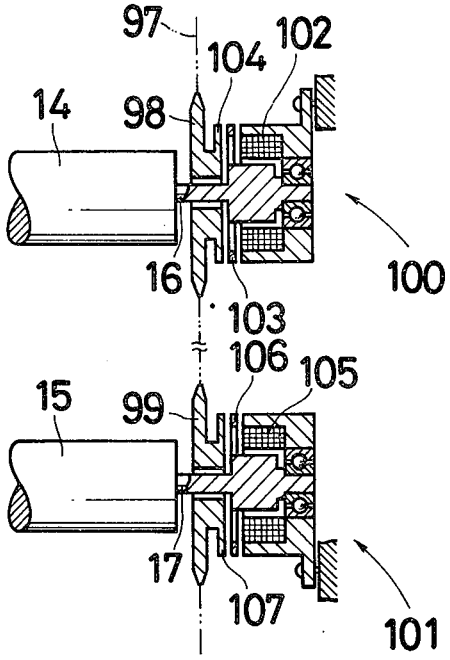
FIG. 3 is a cross-sectional view showing a vicinity of the ends of the feeding rollers of FIG. 2.

FIG. 3 is a cross-sectional view showing a vicinity of the ends of the feeding rollers 14 and 15. Magnetic clutches 100 and 101 are respectively provided on one end of each of the feeding rollers 14 and 15 and have sprocket wheels 98 and 99 which are connected by a chain 97 which is driven by a driving means (not shown). The magnetic clutches 100 and 101 are mounted to the housing of the copying apparatus. On energizing a coil 102 of the magnetic clutch 100, a rotary disk 103 and a clutch plate 104 are connected to each other by a magnetic force, so that the rotary shaft 16 and the feeding roller 14 are driven so as to rotate in the same direction as the sprocket wheel 98 so as to thereby feed the copy paper sheet in the cassette 12. When the coil 102 is not energized, the rotary disk 103 and the clutch plate 104 are apart from each other and the sprocket wheel 98 rotates freely around the rotary shaft 16. In the same manner, when the coil 105 of the magnetic clutch 101 is energized, a rotary disk 106 and a clutch plate 107 are connected to each other by a magnetic force, so that the rotary shaft 17 and the feeding roller 15 are driven so as to rotate with the sprocket wheel 99. When the coil 105 is not energized, the sprocket wheel 99 is rotated freely around the rotary shaft 17.

Figure 4:
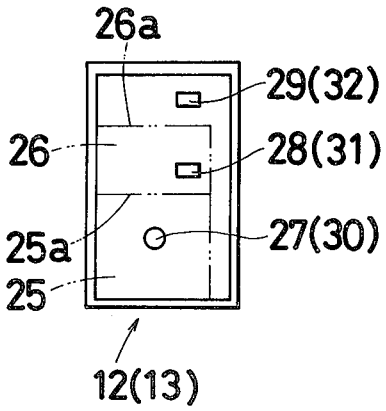
FIG. 4 is a top plan view of a cassette.

FIG. 4 is a top plan view of the cassette 12 which is mounted on the upper portion of the copying apparatus. A switch 27 is provided on the bottom of the cassette 12 in an area 25 wherein the copy paper sheets having a JIS B5 size are stacked as shown by the imaginary line *25a*. There is also provided a switch 28 in an area 26 wherein the copy paper sheets having a JIS A4 size are stacked as shown by the imaginary line *26a*, said switch 28 being in an area outside of the area 25 corresponding to the JIS B5 size. A switch 29 is further provided outside the area 26 corresponding to the JIS A4 size. These switches 27, 28 and 29 detect whether or not there are copy paper sheets in the cassette 12 and detect the size of the stored copy paper sheets. The lower cassette 13 has on the bottom thereof switches 30, 31 and 32 respectively situated in the same manner as the upper cassette 12.

Figure 5:
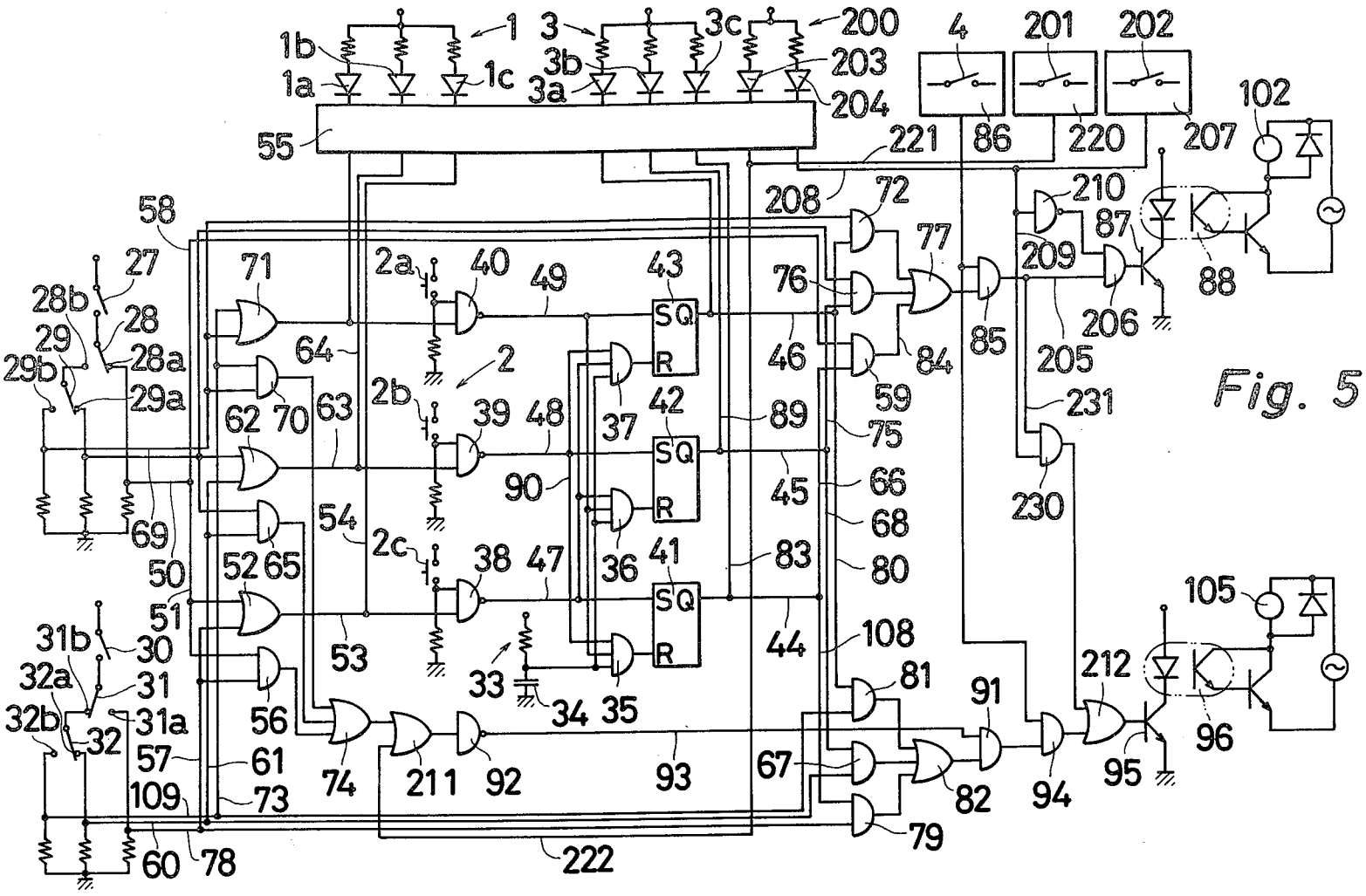
FIG. 5 is an electric circuit diagram.

FIG. 5 is an electric circuit diagram associated with the display element 1 for indicating the size of the stored copy paper sheets, the operation element 2 and the selecting display element 3. The switches 27 and 30 are turned on when any size copy paper sheets are stored in the cassettes 12 and 13. The switches 28 and 31 are respectively connected to contacts *28a* and *31a* when the cassettes 12 and 13 store copy paper sheets having a JIS B5 size, while the switches 28 and 31 are respectively connected to the contacts *28b* and *31b* when the cassettes 12 and 13 store copy paper sheets having a JIS A4 size or a JIS B4 size. The switches 29 and 32 are respectively connected to contacts *29a* and *32a* when the cassettes 12 and 13 store copy paper sheets having a JIS B5 size of a JIS A4 size, and the switches 29 and 32 are respectively connected to the contacts *29b* and *32b* when the cassettes 12 and 13 store the copy paper sheets having a JIS B4 size.

Turning on a power switch (not shown) of the copying apparatus, a capacitor 34 provided in a reset circuit 33 is charged gradually, and low level signals from the reset circuit 33 are supplied to AND gates 35, 36 and 37 individually during the charging period. Accordingly, the AND gates 35, 36 and 37 supply low level signals to flip-flops 41, 42 and 43 so as to reset the flip-flops 41, 42 and 43, immediately after the power switch has turned on. As a result, the flip-flops 41, 42 and 43 supply low level signals to lines 44, 45 and 46. After the capacitor 34 has charged, the outputs of the flip-flops 41, 42 and 43 become high level. At this time, since the selecting switches *2a, 2b* and *2c* are turned off, NAND gates 38, 39 and 40 supply high level signals to lines 47, 48 and 49, so that the AND gates 35, 36 and 37 are receiving high level signals. Therefore, the output of the AND gates 35, 36 and 37 becomes a high level.

In this state, when the flip-flops 41, 42 and 43 are receiving low level signals through lines 47, 48 and 49, so as to set the flip-flops 41, 42 and 43, the flip-flops 41, 42 and 43 respectively supply high level signals to lines 44, 45 and 46.

Let us assume that the upper cassette 12 stores copy paper sheets having a JIS B5 size and the lower cassette 13 stores copy paper sheets having a JIS A4 size. In connection with the upper cassette 12, the switch 27 is turned on and the switch 28 contacts contact *28a*, so as to supply a high level signal through lines 50 and 51 to an input terminal of the OR gate 52. Then, the OR gate 52 supplies a high level signal through lines 53 and 54 to a display lamp driving circuit 55 so as to actuate the display lamp *1c* of the display element 1 for indicating that copy paper sheets having a JIS B5 size are stored. Since the high level signal via the line 51 is also supplied to one input terminal of an AND gate 56 and the switch 31 contacts the other contact *31b*, the AND gate 56 receives a low level signal via a line 57 at the other input terminal of the AND gate 56. Accordingly, the output signal of the AND gate 56 is a low level. Also, an AND gate 59 receives a high level signal at one input terminal thereof via a line 58 and a low level signal at the other input terminal from the flip-flop 41 via lines 44 and 66 to supply a low level signal. Accordingly, the output signal of the AND gate 59 is a low level.

In connection with the lower cassette 13, the switch 30 turns on and the switch 31 is connected to the other contact *31b*. Since the switch 32 is connected to one contact *32a*, OR gate 62 receives a high level signal at one input terminal via lines 60 and 61. The high level signal from the OR gate 62 is provided to the display lamp driving circuit 55 via lines 63 and 64 to actuate the display lamp *1b* of the display element 1 for indicating that copy paper sheets having a JIS B4 size are stored. Also, an AND gate 65 receives at one input terminal a high level signal via the line 61 and receives at the other input terminal a low level signal since in connection with the upper cassette 12, the switch 28 is connected to one contact *28a*, to supply a low level signal at the output terminal of the AND gate 65. An AND gate 67 receives at one input terminal high level signal via the line 60 and receives at the other input terminal low level signal from the flip-flop 42 via lines 45 and 68, to supply a low level signal at an output terminal of the AND gate 67.

Since the switch 28 is connected to one contact 28*a*, each of an AND gate 70, an OR gate 71 and an AND gate 72 receives a low level signal at each input terminal via the line 69. Therefore, AND gates 70 and 72 supply low level signals. Since the switch 32 is connected to one contact 32*a*, the OR gate 71 receives a low level signal at the other input terminal via lines 109 and 73. Therefore, the OR gate 71 supplies a low level signal. Since AND gates 56, 65 and 70 supply low level signals, an OR gate 74 which is responsive to these low level signals supplies a low level signal. Since the flip-flop 42 supplies a low level signal to one input terminal of an AND gate 76 via lines 45 and 75, the AND gate 76 supplies a low level signal. Therefore, an OR gate 77 which is responsive to the low level signals from AND gates 59, 76 and 72 supplies a low level signal. An AND gate 79 receives a low level signal at one input terminal from a line 78 to supply a low level signal. Since the flip-flop 43 supplies a low level signal to one input terminal of an AND gate 81 via lines 46 and 80, the AND gate 81 provides a low level signal. Therefore, an OR gate 82 which is responsive to low level signals from the AND gates 79, 67 and 81 supplies a low level signal.

In this situation, the selecting switch 2*c* of the operation element 2 is manually operated to perform a copying operation using copy paper sheets having a JIS B5 size. When the selecting switch 2*c* is on, a high level signal is provided to one input terminal of the NAND gate 38. At this time, the NAND gate 38 receives a high level signal to the other input terminal via the line 53, and therefore, the NAND gate 38 supplies a low level signal to the line 47. Consequently, the flip-flop 41 is set to supply a high level signal to the display lamp driving circuit 55 via lines 44 and 83, so as to turn on the display lamp 3*c* of the selecting display element 3 for indicating a JIS B5 size. The other input terminal of the AND gate 59 receives a high level signal via lines 44 and 66. At this time, since the AND gate 59 receives a high level signal at one input terminal via the line 58, the AND gate 59 supplies a high level signal to the OR gate 77 via a line 84. The OR gate 77 supplies a high level signal to one input terminal of an AND gate 85. The other input terminal of the AND gate 85 is coupled to a circuit 86 for generating a copying operation signal, the circuit 86 including the print button 4 as shown in FIG. 1. The circuit 86 for generating the copying operation signal provides a high level signal when the copying operation is commenced after operation of the print button 4, and provided a low level signal after completion of the copying operation. The AND gate 85 receives a low level signal at the other input terminal and supplies a low level signal when the print button 4 is not manually operated.

The AND gate 85 supplies an output signal via a line 205 to one input terminal of an AND gate 206. The other input terminal of the AND gate 206 is coupled to an output terminal of a NAND gate 210. Input terminal of the NAND gate 210 is coupled via lines 208 and 209 to the signal generating circuit 207 including a switch 202 for selecting feeding rollers as shown in FIG. 1. The signal generating circuit 207 provides a high level signal when the feeding roller selecting switch 202 is manually operated to drive the feeding roller 15, that is, to feed copy papers from the lower cassette 13 as shown in FIG. 2. On the contrary, the signal generating circuit 207 provides a low level signal when the feeding roller selecting siwtch 202 is not manually operated, so that the AND gate 206 receives at the other input terminal a high level signal from the NAND gate 210.

Since copy paper sheets having a JIS B5 size are stored in the cassette 12 as set forth previously, the circuit 86 for generating the copying operation signal supplies a high level signal to the other input terminal of the AND gate 85 when the print button 4 is manually operated and the feeding roller selecting switch 202 is manually operated. Therefore, the AND gate 85 provides a high level signal to one input terminal of the AND gate 206, while the AND gate 206 receives a high level signal at the other input terminal from the NAND gate 210. Consequently, the transistor 87 is turned on to enable the phototransistor 88 to energize the coil 102. As a result, the rotary shaft 16 of the feeding roller 14 is coupled to the driving means of the electrostatic copying apparatus to commence the feeding of the copy paper sheets which have a JIS B5 size and which are stored in the upper cassette 12.

After the completion of the copying operation, the circuit 86 for generating the copying operation signal supplies a low level signal, and correspondingly, the AND gate 85 provides a low level signal. Therefore, the AND gate 206 supplies a low level signal so as not to energize the coil 102 and so as to stop the rotation of the feeding roller 14. Consequently, the copy paper sheets having a JIS B5 size cease to be fed.

Let us assume that the selecting switch of the operation element 2 is manually operated to perform a copying operation with copy paper sheets having a JIS A4 size and stored in the cassette 13 after completion of a copying operation using the JIS B5 sized copy paper sheets. As a result, the AND gate 39 supplies a low level signal since the NAND gate 39 receives high level signals at both input terminals. The flip-flop 42 is set to provides a high level signal when the input signal via the line 48 to the flip-flop 42 changes from a high level to a low level. The high level signal is coupled to the display lamp driving circuit 55 via a line 89, and correspondingly, the display lamp 3*b* of the selecting display element 3 corresponding to the JIS A4 size is turned on. At this time, the AND gate 35 receives a low level signal via lines 48 and 90, and accordingly, the low level signal from the AND gate 35 is supplied to the flip-flop 41. As a result, the flip-flop 41 is reset to supply a low level signal on the line 44. Therefore, the low level signal is supplied via the line 83 to the display lamp driving circuit 55 to turn off a display lamp 3*c* of the selecting display element 3 for indicating the JIS B5 size. The high level signal on the line 45 is supplied via the line 68 to the other input terminal of the AND gate 67. At this time, one of the input terminals of the AND gate 67 receives a high level signal via the line 60. Therefore, the AND gate 67 supplies a high level signal via the OR gate 82 to one input terminal of the AND gate 91.

The other input terminal of the AND gate 91 is connected to the output terminal of the AND gate 92, while the input terminal of the AND gate 92 is connected to the output terminal of the OR gate 211. The OR gate 211 has one input terminal connected to the input terminal of the OR gate 74. The OR gate 211 has the other input terminal connected via lines 211 and 222 to a signal generating circuit 220 including a feeding roller selecting switch 201 as shown in FIG. 1. The signal generating circuit 220 provides a high level signal when the feeding roller selecting switch 201 is manually operated to select driving operation of the feeding roller 14, that is, the copy paper sheets stored in the upper cassette 12 shown in FIG. 2 are to be fed, and also provides a low level signal when feeding roller selecting switch 201 is not operated.

When the feeding roller selecting switch 201 is not manually operated under the condition that the copy paper sheets having a JIS B4 are stored in the lower cassette 13 as set forth previously, the OR gate 211 receives low level signals from the OR gate 74 and the signal generating circuit 220 via lines 221 and 222. Accordingly, the OR gate 211 provides a low level signal to the NAND gate 92 which, therefore, provides a high level signal to the other input terminal of the AND gate 91 via the line 93. As a result, the AND gate 91 supplies a high level signal to one input terminal of the AND gate 94.

The AND gate 94 has the other input terminal connected to the circuit 86 for generating a copying operation signal, and has an output terminal connected to one input terminal of an OR gate 212. The OR gate 212 has the other input terminal connected to an output terminal of an AND gate 230. One input terminal of the AND gate 230 is connected to the line 209. The other input terminal of the AND gate 230 is connected to the line 231 which is connected to the line 205. When the feeding roller selecting switch 202 is manually operated, the AND gate 230 receives a high level signal from the signal generating circuit 207 at one input terminal of the AND gate 230. In this situation, the AND gate 85 supplies a high level signal to cause the AND gate 230 to provide a high level signal to the OR gate 212, while the AND gate 85 supplies a low level signal to cause the AND gate 230 to provide a low level signal to the OR gate 212.

On manually operating the print button 4, the circuit 86 for generating a copying operation signal supplies a high level signal to the other input terminal of the AND gate 94. The AND gate 94 receives a high level signal at one input terminal as mentioned previously, and therefore, the AND gate 94 provides a high level signal to cause the OR gate 212 to provide a high level signal irrespective of the operation of the feeding roller selecting switch 202. As a result, the transistor 95 is turned on to enable the phototransistor 96 to energize the coil 105. As a result, copy paper sheets which are stored in the lower cassette 13 and have a JIS A4 size are fed.

Let us assume that either of the upper and lower cassettes 12 and 13 stores copy paper sheets which have the same size, such as a JIS B5 size. In this situation, the switch 31 mounted in the lower cassette 13 is coupled to one contact 31*a* to provide a high level signal to the other input terminal of the OR gate 52 via lines 78 and 57. The OR gate 52 receives at one input terminal a high level signal via the line 51 and provides a high level signal to the display lamp driving circuit 55 via lines 53 and 54 to turn on the display lamp 1*c* of the display device for indicating the size of the stored copy paper sheets so as to indicate the JIS B5 size.

Then, the selecting switch 2*c* of the operation element 2 is manually operated, the NAND gate 38 receives at both input terminals high level signals, and accordingly provides a low level signal on the line 47 to set the flip-flop 41. The display lamp driving circuit 55 receives a high level signal from the flip-flop 41 via lines 44 and 83, and accordingly, the display lamp 3*c* of the selecting display element 3 is turned on to indicate JIS B5 size. The AND gate 59 receives a high level signal at one input terminal from the flip-flop 41 via lines 44 and 66, and receives a high level signal at the other input terminal via the line 58. Therefore, the AND gate 59 provides a high level signal via a line 84 and the OR gate 77 to one input terminal of the AND gate 85. The flip-flop 41 also provides a high level signal to one input terminal of the AND gate 79 via lines 44 and 108. The AND gate 79 receives a high level signal at the other input terminal via the line 78 to provide a high level signal through the OR gate 82 to one input terminal of the AND gate 91. At this time, the AND gate 56 respectively receives high level signals at both input terminals via lines 51 and 57 so as to provide a high level signal to the OR gate 74. The OR gate 74 provides a high level signal via the OR gate 211 to the NAND gate 92. Accordingly, the NAND gate 92 provides a low level signal via line 93 to the AND gate 91. Therefore, the AND gate 91 provides a low level signal.

Then, the print button 4 is manually operated, and the circuit 86 for generating a copying operation signal respectively provides a high level signal to the other input terminals of the AND gates 85 and 94. In this situation, since the AND gate 85 receives a high level signal at one input terminal from the OR gate 77, the AND gate 85 provides a high level signal to one input terminal of the AND gate 206.

In this situation, let us assume that the feeding roller selecting switch 202 is not manually operated, that is, the lower cassette 13 is not specifically chosen. The AND gate 206 receives a high level signal at the other input terminal to provide a high level signal therefrom. Accordingly, the transistor 87 is turned on to enable the phototransistor 88 to energize the coil 102. Therefore, the feeding roller 14 is driven so as to rotate and to thereby commence feeding of the copy paper sheets which are stored in the upper cassette 12 and have a JIS B5 size. On the contrary, since the AND gate 94 receives at one input terminal a low level signal from the AND gate 91, the AND gate 94 maintains a low level signal at one input terminal of the OR gate 212. The OR gate 212 receives at the other input terminal a low level signal from the AND gate 230 under the condition where the feeding roller selecting switch 202 is not manually operated, and maintains a low level signal so as not to energize the coil 105. Therefore, at first, the copy paper sheets stored in the upper cassette 12 and having a JIS B5 size are fed.

In this situation, let us assume that the upper cassette 12 stores the copy paper sheets which have a JIS B5 size and are undesirably colored, and let us further assume that the feeding roller selecting switch 202 is manually operated to feed copy paper sheets which are stored in the lower cassette 13 and have a JIS B5 size. Signal generating circuit 207 provides a high level signal via the line 28 to the display lamp driving circuit 55 to turn on the display lamp 204. The AND gate 206 receives a low level signal from the NAND gate 210 at the other input terminal to provide a low level signal so as to not energize the coil 102. The AND gate 230 receives at one input terminal a high level signal via line 231 from the AND gate 35 and receives at other input terminal a high level signal via the line 209 from the signal generating circuit 207, and consequently supplies a high level signal to the other input terminal of the OR gate 212 to energize the coil 105. Accordingly, a feeding operation is performed so as to feed the copy paper sheets which are stored in the lower cassette 12 and have a desired JIS B5 size.

When copying operations are performed successively without operating the feeding roller selecting switch 202 and thus all the copy paper sheets stored in the upper cassette 12 and having a JIS B5 size are fed out, the switch 27 is closed. Accordingly, a signal on the line 50 is low level and supplied via the line 51 to one input terminal of the OR gate 52. The OR gate 52 receives a high level signal at the other input terminal via lines 78 and 57, and continues to supply a high level signal therefrom to maintain the condition that the display lamp 1*c* of the display element 1 for indicating the size of the stored copy paper sheets and the display lamp 3*c* of the selecting display element 3 are actuated. The AND gate 59 receives a low level signal at one input terminal via lines 50 and 58, and thus supplies a low level signal therefrom. Therefore, the coil 102 is not energized so as to stop the driving and rotation of the feeding roller 14.

The signal on the line 50 is at low level, and thus the AND gate 56 supplies a low level signal. At this time, the AND gates 65 and 70 continue to supply low level signals. Therefore, the OR gate 74, in response to these low level signals from the AND gates 56, 65 and 70, supplies a low level signal to one input terminal of the OR gate 211. In the case where the feeding roller selecting switch 201 is not manually operated, that is, the upper cassette 13 is not specifically chosen to feed copy papers, the OR gate receives a low level signal at the other input terminal. Accordingly, the NAND gate 92 supplies a high level signal via the line 93 to the other input terminal of the AND gate 91. The AND gate 91 receives at one input terminal thereof a high level signal from the OR gate 82. Therefore, the AND gate 91 supplies a high level signal to one input terminal of the AND gate 94. Since the AND gate 94 receives at the other input terminal a high level signal from the circuit 86 for generating a copying operation signal, the AND gate 94 supplies a high level signal. Accordingly, the OR gate 212 supplies a high level signal to cause the transistor 95 to be turned on so as to actuate the phototransistor 96. Therefore, the coil 105 is energized to enable the rotation of the feeding roller 15. As a result, the copy paper sheets stored in the lower cassette 13 and having a JIS B5 size are fed.

In this situation, let us assume that the selecting switch 201 is manually operated so as to not feed out the copy paper sheets which are stored in the lower cassette 13 and have a JIS B5 size, which are not desired as set forth previously, the signal generating circuit 220 supplies a high level signal via the line 211 to the display lamp driving circuit 55, so that the display lamp 213 is turned on. Since the signal generating circuit 220 supplies the high level signal via lines 221 and 222 to the other input terminal of the OR gate 211, the OR gate 211 supplies a high level signal to cause the NAND gate 92 to supply a low level signal. Accordingly, the coil 105 is not energized as set forth previously. As a result, the desired copy paper sheets stored in the lower cassette 13 and having a JIS B5 size are not fed.

The copy paper sheets having a JIS B5 size are fed out from the lower cassette 13, and consequently the copy paper stored in the lower cassette 13 are entirely fed out, and then the switch 30 is opened. Consequently, AND gates 79, 67 and 81 receive low level signals via lines 78, 60 and 109 individually to cause the OR gate 82 to supply a low level signal. Therefore, AND gates 91 and 94 respectively supply low level signals, and the OR gate 211 receives at an input terminal a low level signal from the AND gate 94. On the contrary, the other input terminal of the OR gate 212 receives a low level signal from the AND gate 230. Therefore, the coil 105 is not energized so as to stop the rotation of the feeding roller 15.

In this fashion, in the case where the copy paper sheets having the same size are respectively stored in the cassettes 12 and 13, first, the copy paper sheets stored in the upper cassette 12 are fed out until the upper cassette 12 is empty, then the copy paper sheets stored in the lower cassette 13 are fed out. In the case where one of the cassettes 12 and 13 stores the undesired copy paper sheets, even if these two cassettes 12 and 13 store the copy paper sheets having the same size, only the desired copy paper sheets are capable of being fed out from the remaining cassette 12 or 13.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which come within the meaning and range of equivalency of the claims are therefore intended to be embraced therein.

What is claimed is:

1. A copy paper feeding device for a copying apparatus comprising:

a pair of cassettes capable of storing copy paper sheets;

a pair of feeding means, each corresponding to one of said pair of cassettes, for feeding said copy paper sheets; wherein one of said pair of feeding means is driven selectively to feed copy paper sheets in the case where said cassettes store copy paper sheets having two different sizes, and wherein each of said pair of feeding means is driven in a predetermined order so as to feed copy paper sheets from one cassette until said cassette is empty and then to feed copy paper sheets from the remaining cassette successively in the case where said cassettes store copy paper sheets having the same size; and a pair of means for selecting a feeding means to be driven in order that the selected feeding means feeds copy paper sheets; wherein each of said means for selecting a feeding means corresponds to one of said pair of feeding means;

a display element for indicating sizes of said stored copy paper sheets and having a plurality of first display lamps respectively corresponding to sizes of the copy paper sheets;

an operation device for selecting one of said copy paper sheet sizes and having a plurality of first size selecting switches respectively corresponding to said first display lamps;

a selecting display element for indicating the selected size and having a plurality of second display lamps respectively corresponding to said first display lamps;

a pair of copy paper detecting means for detecting whether copy paper sheets are stored in each of said pair of cassettes, and for detecting the sizes of said stored copy paper sheets;

a control means which is responsive to a signal from said pair of copy paper detecting means for driving said display element for indicating sizes of said stored copy paper sheets, and which is responsive to a signal from said pair of copy paper detecting means and a signal from each of said size selecting switches for driving said selecting display element;

a pair of selective switches for selecting one of said pair of feeding means and a display element having a plurality of display lamps, each of said display lamps being situated so as to respectively correspond to one of said pair of feeding means and indicating the selected feeding means; wherein said control means is responsive to signals from said feeding means selecting switches so as to drive said display element and to drive said feeding means corresponding to said selected cassette;

said operation device including a plurality of flip-flops, each of which is respectively connected to one of said plurality of size selecting switches through a corresponding NAND gate and wherein each of said size selecting switches comprise momentary contact switches, said switches and flip-flops being arranged such that each of said flip-flops is set in response to an operation of its corresponding switch;

said operation device further including a plurality of AND gates, each of which is connected to one of said plurality of flip-flops and having inputs connected to all of said size selecting switches except for said size selecting switch corresponding to its corresponding flip-flop;

said AND gates arranged such that when one of said flip-flops is set, the remaining flip-flops are reset;

said control means including a plurality of OR gates connected to said pair of copy paper detecting means, wherein each of said copy paper detecting means comprise a plurality of individual detectors;

each of said OR gates being respectively connected to one of said NAND gates so as to enable or disable the operation of its corresponding size selecting switch in response to two of said individual detectors which comprise said pair of copy paper detecting means;

said control means further including a plurality of additional OR gates, each of which is respectively connected to two of said individual detectors which comprise said pair of copy paper detecting means;

said OR gates operatively connected to said feeding means so as to enable or disable the operation thereof in response to said copy paper detecting means.

* * * * *